US010900129B2

(12) United States Patent
Tschuncky et al.

(10) Patent No.: US 10,900,129 B2
(45) Date of Patent: Jan. 26, 2021

(54) ELECTROCHEMICAL GAS GENERATOR FOR AMMONIA WITH THE USE OF IONIC LIQUIDS AND USE OF THE GAS GENERATOR

(71) Applicant: Dräger Safety AG & Co. KGaA, Lübeck (DE)

(72) Inventors: Peter Tschuncky, Lübeck (DE); Kerstin Lichtenfeldt, Timmendorfer Strand (DE)

(73) Assignee: Dräger Safety AG & Co. KGaA, Lübeck (DE)

( * ) Notice: Subject to any disclaimer, the term of this patent is extended or adjusted under 35 U.S.C. 154(b) by 239 days.

(21) Appl. No.: 15/277,330

(22) Filed: Sep. 27, 2016

(65) Prior Publication Data

US 2017/0088957 A1 Mar. 30, 2017

(30) Foreign Application Priority Data

Sep. 28, 2015 (DE) ..... 10 2015 012 440

(51) Int. Cl.

| | |
|---|---|
| ***C25B 1/00*** | (2006.01) |
| ***C25B 11/04*** | (2006.01) |
| ***C25B 9/08*** | (2006.01) |
| ***C25B 11/12*** | (2006.01) |

(52) U.S. Cl.

CPC ..... *C25B 1/00* (2013.01); *C25B 9/08* (2013.01); *C25B 11/04* (2013.01); *C25B 11/041* (2013.01); *C25B 11/0447* (2013.01); *C25B 11/12* (2013.01)

(58) Field of Classification Search

None

See application file for complete search history.

(56) References Cited

U.S. PATENT DOCUMENTS

| | | | | |
|---|---|---|---|---|
| 8,414,751 | B2 | 4/2013 | Nauber et al. | |
| 9,005,422 | B2 | 4/2015 | Jiang et al. | |
| 9,395,323 | B2 | 7/2016 | Warratz | |
| 2003/0164305 | A1* | 9/2003 | Denvir | C25B 1/00 205/360 |
| 2006/0049063 | A1 | 3/2006 | Murphy et al. | |
| 2006/0283707 | A1* | 12/2006 | Kuhn | G01N 27/404 204/424 |
| 2008/0078671 | A1 | 4/2008 | Caro et al. | |

(Continued)

FOREIGN PATENT DOCUMENTS

| | | | |
|---|---|---|---|
| AU | 629166 | B2 | 10/1992 |
| CN | 102087242 | A | 6/2011 |
| CN | 103154323 | A | 6/2013 |

(Continued)

OTHER PUBLICATIONS

Pappenfus et al. "Wind to Ammonia: Electrochemical Processes in Room Temperature Ionic Liquids" ECS Transactions, 16, 49, 89-93, 2009 (Year: 2009).*

(Continued)

*Primary Examiner* — Stefanie S Wittenberg

(74) *Attorney, Agent, or Firm* — McGlew and Tuttle, P.C.

(57) ABSTRACT

An electrochemical gas generator for ammonia with the use of ionic liquids containing nitrate ions as the electrolyte and to the use of the gas generator for generating gaseous ammonia, especially for testing the function of and/or calibrating gas sensors.

19 Claims, 1 Drawing Sheet

(56) References Cited

U.S. PATENT DOCUMENTS

| | | | | |
|---|---|---|---|---|
| 2009/0057161 | A1* | 3/2009 | Aulich | C05C 1/00 205/436 |
| 2014/0072836 | A1 | 3/2014 | Mills | |

FOREIGN PATENT DOCUMENTS

| | | | |
|---|---|---|---|
| CN | 103460469 | A | 12/2013 |
| CN | 103890577 | A | 6/2014 |
| DE | 10 2005 028 246 | A1 | 12/2006 |
| EP | 3222753 | A2 | 9/2017 |

OTHER PUBLICATIONS

CN 102 087 242 A was disclosed in an earlier Information Disclosure Statement filed Sep. 28, 2018.
US 2006/049063 A1 was disclosed in an earlier Information Disclosure Statement filed Sep. 27, 2016.
CN 103 154 323 A was disclosed in an earlier Information Disclosure Statement filed Sep. 28, 2018.
AU 629 166 B2 was disclosed in an earlier Information Disclosure Statement filed Sep. 28, 2018.

* cited by examiner

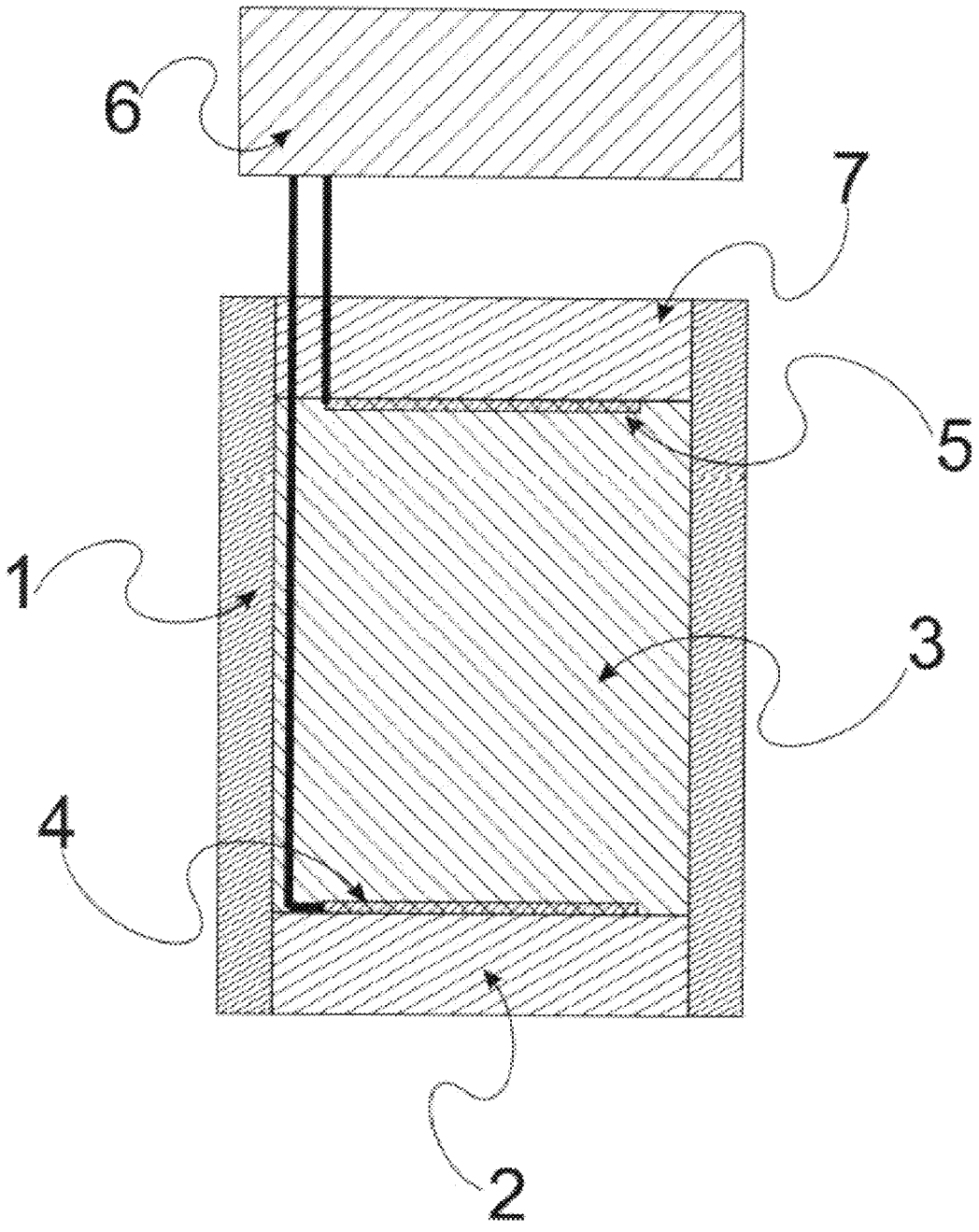
6
7
5
1
3
4
2

ELECTROCHEMICAL GAS GENERATOR FOR AMMONIA WITH THE USE OF IONIC LIQUIDS AND USE OF THE GAS GENERATOR

CROSS REFERENCE TO RELATED APPLICATIONS

This application claims the benefit of priority under 35 U.S.C. § 119 of German Application 10 2015 012 440.4 filed Sep. 28, 2015, the entire contents of which are incorporated herein by reference.

FIELD OF THE INVENTION

The present invention pertains to an electrochemical gas generator for ammonia with the use of ionic liquids containing nitrate ions as an electrolyte and to the use of the gas generator for generating gaseous ammonia, especially for the function testing and/or calibration of gas sensors.

BACKGROUND OF THE INVENTION

The measured gas to be detected or a suitable substitute gas is admitted, in general, to gas sensors at certain specified intervals for testing their function and calibrating them. Test gas in pressurized gas cylinders can be used for this together with suitable gas admission devices, for example, with pressure reducers, or the test gas in question may be generated directly chemically. The use of pressure tanks with corresponding devices is complex and requires corresponding logistics and handling.

Suitable chemical reactions for generating gaseous ammonia must be able to be miniaturized, must not require high activation energies, should be intrinsically safe as much as possible, must be able to be switched on and off quickly and also be able to be used over rather long periods, even interrupted by times during which they are not used. These requirements are met by an electrochemical gas generator in an ideal manner.

It is known that electrochemical ammonia generators based on aqueous ammonia solutions can be manufactured. The pH value of the electrolyte solution is shifted here locally into the alkaline range at a generator electrode by reducing oxygen from the ambient air and ammonia is produced in a subsequent reaction by deprotonating ammonium ions:

$$O_2+4e^-+2H_2O \rightarrow 4OH$$

$$NH_4^+ + OH^- \rightarrow NH_3 + H_2O$$

However, aqueous ammonium salt solutions have a considerable vapor pressure, so that the electrolyte solutions run the risk of drying relatively quickly. Thus, the equilibrium moisture content of a saturated aqueous $NH_4Cl$ solution is 79% rh at 20° C.

Another prior-art method for electrochemical ammonia generation is the electrolysis of nitrate-containing aqueous salt solutions, wherein nitrate anions are reduced into ammonia:

$$NO_3^- + 8e^+ + 9H^+ \rightarrow NH_3 + 3H_2O.$$

The great problem that the vapor pressure of aqueous nitrate-containing salt solutions is high occurs here as well, which in turn leads to the evaporation of the solvent and/or to precipitation of the salt. Thus, the equilibrium moisture content of a saturated aqueous $LiNO_3$ solution is 60% rh at 20° C.

Ionic liquids are salts that are in the liquid state at temperatures below 100° C. A large number of research studies have been devoted to these compounds in recent years, and the estimated number of compounds is very large. For example, ammonium, guanidinium, imidazolium, morpholinum, phosphonium or pyrrolidinium ions are used as possible cations. Among others, acetates, amides and imides, borates, cyanates, halides, phosphates and phosphinates are at the center of interest as anions.

SUMMARY OF THE INVENTION

There is a need for a robust electrochemical gas generator for ammonia, which requires as little maintenance as possible and has the greatest storage stability possible, for use under typical climatic conditions occurring on earth.

The object of the present invention is therefore to create a gas generator for generating ammonia for monitoring the function of gas sensors, which combines the long-term stability and drying resistance of the electrolyte with a low technical effort for manufacture and does not require high activation energies, can be configured such that it is as intrinsically safe as possible, can be switched on and off quickly and remains usable over rather long times even if interrupted by times during which it is not used.

The object is accomplished according to the present invention by the subject of the independent patent claims. Preferred embodiments are the subject of the subclaims or as described below.

The gas generator according to the present invention comprises an electrochemical cell with at least one working electrode and with at least one counterelectrode as well as with at least one electrolyte, comprising an ionic liquid based on a nitrate salt, preferably with a melting point below 25° C. Hydrocarbon-substituted ammonium nitrate compounds, such as especially ethylammonium nitrate (EAN), ethylimidazolium nitrate or methylimidazolium nitrate are especially suitable.

Drying-resistant gas generators having long-term stability can be prepared with nitrate-containing electrolyte system for generating ammonia due to the simultaneous use of, e.g., EAN as both a solvent and as an electrolyte salt and as an educt of the generation reaction in the electrochemical gas generator.

The $NH_3$ gas generators according to the present invention, containing ionic liquids, may be used, e.g., for the function testing and calibration of gas sensors.

According to one embodiment, the electrochemical gas generator contains as the electrolyte an ammonium nitrate salt (hydrocarbon-substituted ammonium nitrate compound), which is described by the general formula:

$$R^1R^2R^3R^4R^+NO_3^-,$$

in which $R^{1-4}$ denote, independently from one another, H or C1- to C6-hydrocarbon radical, with at least one R=C1- to C6-hydrocarbon radical. Two or more of the $R^1$ $R^2$ $R^3$ $R^4$ radicals may also form a ring. The cation is preferably selected from the group of mono-, di-, tri- and/or tetraalkylammonium salts, the individual alkyl groups being linear or branched and containing 1 to 6 carbon atoms each, preferably 2 to 4 carbon atoms, and the alkyl groups being identical or different.

A preferred example herefor is ethylammonium nitrate (EAN), a substance that is liquid at room temperature. EAN has a melting point of only +12° C., whereas "true salts," e.g., NaCl, have melting points higher than 800° C. and are liquid at room temperature in the dissolved form only.

Furthermore, it is also possible to use a C1- to C6-hydrocarbon-monosubstituted or polysubstituted imidazolium nitrate salt, which is, e.g., 1,3-(C1 to C6) alkyl-substituted, the substituents preferably being alkyl groups and the individual alkyl groups being linear and/or branched and each containing 1 to 6 carbon atoms, preferably 1 to 2 carbon atoms, and the alkyl groups being identical or different.

Especially suitable ionic liquids are the following nitrates: Ethylammonium nitrate (EAN), propylammonium nitrate, ethylimidazolium nitrate, methylimidazolium nitrate and mixtures thereof, and especially preferably EAN.

As an ionic liquid, the electrolyte may be present without additional liquid additives or diluted with a diluent that is inert with respect to the electrochemical reaction and/or be absorbed in an absorbent solid.

It may, however, still be desirable even in case of ionic liquids for some applications to further lower the melting point of the electrolyte liquid. Thus, many "liquid salts," such as EAN, are liquid or flowable and hence suitable for use only with the use of auxiliary agents or due to heating at low ambient temperatures, which occur, e.g., in cold storage facilities or the like.

Therefore, the use of diluents may be desirable in order to further lower the melting points of the electrolyte and to make the ionic liquids suitable for use at low temperatures as well.

Suitable diluents are high-boiling liquids with a boiling point above 150° C. (at 1013 mbar). Compounds that contain ether groups and optionally additionally hydroxyl and/or carbonyl groups are preferred. Hydroxyalkyl ether, glycol, diglyme or triglyme, butyl diglycol, propylene carbonate and/or ethylene carbonate are mentioned as examples. Additional ionic liquids may be added as well. Especially alkylated imidazolium-bistrifluorosulfonylimide compounds may be added, because these have suitable melting points.

The diluents may be used at a mixing ratio ranging from 20:1 to 1:5 and preferably 10:1 to 1:2 relative to the weight ratio of ionic liquid to diluents.

The electrodes of the electrochemical cell may be consist of a metal of the group comprising Cu, Ni, Ti, Pt, Ir, Au, Pd, Ag, Ru, Sn and Rh or mixtures, alloys or oxides of these metals and of an electrode material consisting of carbon, the materials of the individual electrodes being identical or different. The electrodes are separated from one another in space, either simply by spaced locations or by means of non-conductive separators located between them, e.g., by a porous glass body or/and ones consisting of porous nonwoven materials impregnated with electrolyte.

Additional electrode materials are carbon nanotubes (CNT), glassy carbon, graphene and/or additional electrically conductive carbon electrodes (e.g., doped diamond).

Suitable electrolyte cell housings consist of, e.g., plastics such as polyethylene and/or polypropylene, which provide a non-conductive housing. The ammonia may be discharge, e.g., via an $NH_3$-permeable but liquid-tight membrane. The membrane is a gas diffusion membrane, preferably consisting of a perfluorinated polymer, especially polytetrafluoroethylene (PTFE), polyfluoroalkyl (PFA) or a copolymer of hexafluoropropylene and perfluoroethylene propylene (FEP).

The electrolyte may contain additional components, which do not participate in the electrochemical reaction, e.g., added auxiliary agents, such as acids, buffers, further, other ionic liquids and/or gelling agents to increase, e.g., the shaking resistance.

A control unit, which is connected to the electrodes, is used as the power or voltage source. The control unit may have, furthermore, a potentiostat, preferably a galvanostat. A current of 100 μA to 100 mA typically flows during the electrolysis.

According to another embodiment, the electrolysis cell contains, furthermore, a reference electrode in contact with the electrolyte. The housing is preferably closed by one or more gas-permeable membranes such that the ammonia formed in the gas generator can leave the electrolysis chamber, but the liquid electrolyte is held in the interior of the housing.

The flow of current between the electrodes leads to the electrolysis and thus to the formation of gas at at least one working electrode. The membrane, which is permeable to ammonia but is nonpermeable to the electrolyte, i.e., the ionic liquid including possibly a diluent, is preferably positioned close to or in direct contact with the working electrode. The ammonia generated diffuses through the electrolyte and through the gas-permeable membrane(s), without bubbles forming in the electrolyte, and independently from the orientation of the gas generator, so that the ammonia can reach a sensor to be tested.

The electrodes may be configured in the form of a printed electrode or a sputtered electrode or even an electrode clamped in the housing (e.g., by means of the body consisting of porous glass and/or the nonwoven, which will be explained below), preferably equipped with the smallest possible electrolyte gap.

The gas generator according to the present invention is switched on for testing the sensor, i.e., the flow of current is activated, and is switched off again if the test result is positive or after a predefined testing sequence. According to one embodiment, the interior of the gas generator is partly filled by a body consisting of porous glass (e.g., in the form of a sintered glass body), which ensures uniform wetting of the electrodes by being able to absorb and transport the electrolyte, while storing the electrolytically active medium and ensuring a certain resistance of the arrangement to vibrations.

According to another embodiment, the body consisting of porous glass presses the contact wires onto the electrodes and thus leaves so much space unfilled in the sensor that variations in the degree of filling of the gas generator because of the uptake and release of water from the ambient atmosphere can be compensated. Additional nonwovens (e.g., Whatman GF/F), which lie directly on the electrodes, can distribute the electrolyte on the surface of the electrode based on their wick effect and ensure uniform moistening of the electrodes.

In a preferred embodiment, the electrolyte consists of 1 mL of EAN+0.5 mL of ethylene glycol. The electrolyte or the ionic liquid is exposed to the ambient air and correspondingly already contains small quantities of water at the time of filling, e.g., corresponding to the humidity of the air in the ambient atmosphere. The electrolyte is in close contact with the ambient atmosphere via the PTFE membranes during the operation of the gas generator and therefore absorbs varying percentages of water depending on the location at which it is used.

An additional electrode consisting of Ir/Ir oxide, which can be accommodated in the interior of the glass body, is used according to one embodiment as a reference electrode and made it possible to measure the working potentials of the electrolysis cell during the galvanostatic operation.

The present invention is described in detail below with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 1 is a schematic view showing the configuration of an electrolysis cell, which is used as an electrochemical gas generator for producing ammonia.

DESCRIPTION OF THE PREFERRED EMBODIMENTS

Referring to the drawings, an electrolyte 3 is contained in the electrolysis cell, which comprises a non-conductive housing 1, which is closed by a gas-permeable membrane 2. The cathode 4 and the anode 5 are likewise located within the housing and are in contact with the electrolyte 3. The electrolyte is reacted electrochemically when a direct current voltage is applied to the electrodes by means of the control unit 6 or else a constant current flows over the cell in the sense of a galvanostatic operation. The gas released, $NH_3$, is discharged through the gas-permeable but liquid-tight membrane 2. Gases that may have possibly formed at the counterelectrode can leave the gas generator housing via the optionally installed counterelectrode membrane 7.

Example

A cylindrical electrolysis cell with a diameter of 1.5 cm and a height of 3 cm, made of polypropylene as the material of the housing, was provided. A PTFE membrane coated with carbon nanotubes was welded as a cathode on housing openings in the bottom surface, and a carbon nanotubes-PTFE membrane unit was likewise incorporated as the anode in the cover surface. The circular, flat electrodes had a size of 10 mm in diameter and were contacted by means of platinum wires, which made possible the electrical connection to a galvanostatic control unit. The electrolyte consisting of ethylammonium nitrate $EtNH_3^+ NO_3^-$, diluted 1:1 with ethylene glycol, was split at a constant current flow of 2.5 mA, which means that nitrate was reduced into ammonia at the working electrode and $NH_3$ was released continuously as a gas. The gaseous ammonia formed at the cathode diffused through the permeable membrane consisting of PTFE from the housing of the electrolysis cell and was used for testing a sensor.

While specific embodiments of the invention have been shown and described in detail to illustrate the application of the principles of the invention, it will be understood that the invention may be embodied otherwise without departing from such principles.

What is claimed is:

1. An electrochemical test gas generator comprising:

an electrolysis cell having a housing with a membrane permeable to gaseous ammonia;

a liquid electrolyte disposed in the housing, the liquid electrolyte comprising at least one ionic liquid from a nitrate salt;

at least two electrodes in the housing, which are in contact with the electrolyte; and a power or voltage source, which is connected to the electrodes, wherein the ionic liquid comprises a hydrocarbon-substituted ammonium nitrate compound or a hydrocarbon-substituted imidazolium nitrate compound or both a hydrocarbon-substituted ammonium nitrate compound and a hydrocarbon-substituted imidazolium nitrate compound as a gaseous ammonia source material, which is reduced into ammonia ($NH_3$) at one of the at least two electrodes and releases $NH_3$ continuously as a gas.

2. An electrochemical test gas generator in accordance with claim 1, wherein the ionic liquid comprises ethylammonium nitrate or ethylimidazolium nitrate or methylimidazolium nitrate or any combination of ethylammonium nitrate and ethylimidazolium nitrate and methylimidazolium nitrate.

3. An electrochemical test gas generator in accordance with claim 1, wherein the liquid electrolyte further comprises a diluent that is an organic compound that is liquid at room temperature with a boiling point above 150° C. (at 1013 mbar), having at least one hydroxyl group or at least one C—O—C bond or both at least one hydroxyl group or at least one C—O—C bond.

4. An electrochemical test gas generator in accordance with claim 1, wherein the liquid electrolyte further comprises a diluent selected from hydroxyalkyl ethers, glycol, diglyme, triglyme, ethylene glycol, butyl diglycol, propylene carbonate, ethylene carbonate and mixtures thereof.

5. An electrochemical test gas generator in accordance with claim 1, wherein the liquid electrolyte further comprises one or more additional ionic liquids without a nitrate group.

6. An electrochemical test gas generator in accordance with claim 5, wherein the one or more additional ionic liquids without a nitrate group comprises an alkylated imidazolium-bistrifluorosulfonylimide compound.

7. An electrochemical test gas generator in accordance with claim 1, further comprising a control unit for galvanostatic regulation of an electrolysis current or for potentiostatic control of a working potential.

8. An electrochemical test gas generator in accordance with claim 1, wherein a current of 100 μA to 100 mA flows during electrolysis.

9. An electrochemical test gas generator in accordance with claim 1, further comprising at least one reference electrode in contact with the electrolyte.

10. An electrochemical test gas generator in accordance with claim 9, wherein the reference electrode comprises a metal of the group comprising Cu, Ni, Ti, Pt, Ir, Au, Pd, Ag, Ru, Sn and Rh or mixtures, alloys or oxides of one or more metals of the group.

11. An electrochemical test gas generator in accordance with claim 9, wherein the reference electrode comprises a carbon-containing material comprised of carbon nanotubes (CNT) or graphite or glassy carbon or graphene or doped diamond or any combination of carbon nanotubes (CNT) and graphite and glassy carbon and graphene and doped diamond.

12. An electrochemical test gas generator in accordance with claim 1, wherein the electrodes comprise a metal of the group Cu, Ni, Ti, Pt, Ir, Au, Pd, Ag, Ru, Sn and Rh or mixtures, alloys or oxides of one or more metals of the group, wherein the metals of the electrodes are identical or different.

13. An electrochemical test gas generator in accordance with claim 1, wherein at least one of the electrodes comprises a carbon-containing material comprised of carbon nanotubes (CNT) or graphite or glassy carbon or graphene or doped diamond or any combination of carbon nanotubes (CNT) and graphite and glassy carbon and graphene and doped diamond.

14. An electrochemical test gas generator in accordance with claim 1, wherein the electrochemical test gas generator is a test gas generator for gas sensor calibration and is configured to generate gaseous ammonia with only the liquid electrolyte and the at least two electrodes present in the housing and to direct gaseous ammonia, generated within the housing to leave the housing without any feed material being fed into the housing.

15. An electrochemical test gas generator in accordance with claim 14, further comprising another membrane configured to allow gases, that may have formed within said housing, to leave said housing wherein:

said housing defines only two openings;

said two openings comprise a first opening and a second opening;

said first opening is fully covered by said membrane permeable to gaseous ammonia;

said membrane permeable to gaseous ammonia is configured to be liquid tight;

said second opening is fully covered by said another membrane;

the power or voltage source is connected to the electrodes to generate the gaseous ammonia exclusively with materials within said housing, which said materials comprising the liquid electrolyte and the at least two electrodes; and gases leave the gas generator housing through said membrane permeable to gaseous ammonia and through said another membrane without any feed material being fed into the gas generator housing.

16. An electrochemical test gas generator comprising:

an electrolysis cell comprising a gas barrier housing defining at least one opening closed by a gas permeable membrane permeable to gaseous ammonia;

a liquid electrolyte disposed in the housing, the liquid electrolyte comprising at least one ionic liquid from a nitrate salt, wherein the ionic liquid comprises a hydrocarbon-substituted ammonium nitrate compound or a hydrocarbon-substituted imidazolium nitrate compound or both a hydrocarbon-substituted ammonium nitrate compound and a hydrocarbon-substituted imidazolium nitrate compound;

at least two electrodes in the housing, which are in contact with the electrolyte; and a power or voltage source, which is connected to the electrodes, to reduce the hydrocarbon-substituted ammonium nitrate compound or a hydrocarbon-substituted imidazolium nitrate compound or both a hydrocarbon-substituted ammonium nitrate compound and a hydrocarbon-substituted imidazolium nitrate compound into ammonia at one of the at least two electrodes to continuously generate gaseous ammonia with the liquid electrolyte and the at least two electrodes, whereby gaseous ammonia generated within the gas barrier housing leaves the gas barrier housing without any feed material being fed into the gas barrier housing.

17. An electrochemical test gas generator according to claim 16, further comprising another membrane configured to allow gases, that may have formed within said housing, to leave said housing wherein:

said housing defines only two openings;

said two openings comprise a first opening and a second opening;

said first opening is fully covered by said membrane permeable to gaseous ammonia;

said membrane permeable to gaseous ammonia is configured to be liquid tight;

said second opening is fully covered by said another membrane;

the power or voltage source is connected to the electrodes to generate the gaseous ammonia with the liquid electrolyte and the at least two electrodes; and gases leave said housing through said membrane permeable to gaseous ammonia and through said another membrane without any feed material being fed into said housing.

18. An electrochemical test gas generator comprising:

an electrolysis cell having a housing with a membrane permeable to gaseous ammonia;

a liquid electrolyte disposed in the housing, the liquid electrolyte comprising at least one ionic liquid from a nitrate salt;

at least two electrodes in the housing, which are in contact with the electrolyte; and a power or voltage source, which is connected to the electrodes, the electrodes powered by the power or voltage source cooperating with the liquid electrolyte disposed in the housing to generate gaseous ammonia within the housing with the liquid electrolyte providing the only source material forming the generated gaseous ammonia and wherein the housing is configured to direct gaseous ammonia, generated within the housing, out of the housing, wherein the ionic liquid comprises a hydrocarbon-substituted ammonium nitrate compound or a hydrocarbon-substituted imidazolium nitrate compound or both a hydrocarbon-substituted ammonium nitrate compound and a hydrocarbon-substituted imidazolium nitrate compound, which hydrocarbon-substituted imidazolium nitrate compound is reduced into ammonia at one of the at least two electrodes and to release ammonia continuously as a gas.

19. An electrochemical test gas generator according to claim 18, wherein the electrolyte has a melting point below 25° C.

* * * * *